US008944625B2

(12) United States Patent
Dong

(10) Patent No.: US 8,944,625 B2
(45) Date of Patent: Feb. 3, 2015

(54) UNDERWATER LIGHT FOR SWIMMING POOL

(71) Applicant: Qionghuan Dong, Ningbo (CN)

(72) Inventor: Qionghuan Dong, Ningbo (CN)

( * ) Notice: Subject to any disclaimer, the term of this patent is extended or adjusted under 35 U.S.C. 154(b) by 63 days.

(21) Appl. No.: 13/911,046

(22) Filed: Jun. 5, 2013

(65) Prior Publication Data

US 2014/0362578 A1 Dec. 11, 2014

(51) Int. Cl.

| | |
|---|---|
| ***F21V 31/00*** | (2006.01) |
| ***F21V 15/00*** | (2006.01) |
| ***F21V 17/00*** | (2006.01) |

(52) U.S. Cl.

CPC ..... *F21V 31/005* (2013.01)
USPC ..... 362/101; 362/267; 362/310; 362/374; 362/375

(58) Field of Classification Search

USPC ..... 362/101, 147, 267, 310, 362, 374, 375
See application file for complete search history.

(56) References Cited

U.S. PATENT DOCUMENTS

| | | | | |
|---|---|---|---|---|
| 3,962,675 | A * | 6/1976 | Rowley et al. | 362/101 |
| 4,587,599 | A * | 5/1986 | St-Hilaire | 362/101 |
| 5,045,978 | A * | 9/1991 | Gargle | 362/101 |
| 5,050,052 | A * | 9/1991 | Wade | 362/101 |
| 5,483,428 | A * | 1/1996 | Poppenheimer | 362/101 |
| 5,607,224 | A * | 3/1997 | Tobias et al. | 362/101 |
| 5,842,771 | A * | 12/1998 | Thrasher et al. | 362/101 |
| 6,203,173 | B1 * | 3/2001 | Duff et al. | 362/268 |

* cited by examiner

*Primary Examiner* — Alan Cariaso
(74) *Attorney, Agent, or Firm* — Matthias Scholl P.C.; Matthias Scholl

(57) ABSTRACT

An underwater light includes a hollow aluminum outer casing, a hollow sealing cover, and a screw bolt. The sealing cover is coupled with a head connector of a water inlet pipe via the screw bolt. A light base is provided between the sealing cover and the screw bolt. An annular transparent light cover is installed inside the aluminum outer casing. A circuit board with diode embedded is mounted within the transparent light cover. In addition, a fastener is coupled at the internal top portion of the hollow sealing cover, and the screw end of said fastener is coupled with a nut defined as a nut so as to affix a water outlet. A waterproof connector head is coupled with the internal bottom portion of the hollow sealing cover and a wire hole is provided within the hollow sealing cover.

5 Claims, 2 Drawing Sheets

UNDERWATER LIGHT FOR SWIMMING POOL

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to an underwater light, and more particularly to an underwater light for swimming pool which can be installed and maintained in low cost with high efficiency.

2. Description of Related Arts

Underwater lights are usually provided in a swimming pool to provide the illumination for a user. Conventionally, the wire of the underwater light is directly immersed in the water, and thus a user is easy to risk an electrical shock. In addition, during the installation of the underwater light, its wires are easy to get damage. Especially, it is inconvenient to disassemble the underwater light during winter, so the light is generally kept under the water for a long time resulting that the conventional underwater light would be damaged easily.

According to the conventional underwater lights, the installation and maintenance of the underwater lights are high in cost, low in efficiency, and time-consuming. It is necessary to develop an underwater light to solve the problems as mentioned before to keep the underwater light being convenient to be installed and easier to be used.

SUMMARY OF THE PRESENT INVENTION

The main object of the present invention is to provide an underwater light for swimming pool which is easy to be installed and disassembled.

Another object of the present invention is provide an underwater light, which applies the threaded connection for all connection parts of the underwater light, wherein the internal portion of the underwater light has the multiple sealing effect so as to completely maintain isolation from water.

Another object of the present invention is to provide an underwater light, wherein the installation and disassembling of between the light and light base as well as the connection and disconnection between the electric wire and the power cord from the power source are easily and convenient, that greatly facilitates the installation, disassembling and maintenance of the underwater light while the whole process thereof minimizes the contact with the electric wires and the interior of the swimming pool to avoid damages thereof.

Another object of the present invention is to provide an underwater light, wherein a waterproof plug is applied to connection between the electric wire and the power cord, so that a user is safe to install without the risk of getting electrical shock.

Accordingly, in order to accomplish the above objects, the present invention provides an underwater light comprises a hollow aluminum outer casing, a hollow sealing cover, and a screw bolt. The sealing cover is coupled with a head connector of a water inlet pipe via the screw bolt and a light base provided between the sealing cover and the screw bolt. The aluminum outer casing is coupled on top of the sealing cover; and an annular transparent light cover installed with the aluminum outer casing. A circuit board with diode embedded is mounted within the transparent light cover. A fastener, such as a screw, is coupled at the internal top portion of the hollow sealing cover. The screw end of the fastener is coupled with a nut defined as an eye balls shape so as to affix a water outlet. A waterproof connector head is coupled with the internal bottom portion of the hollow sealing cover and a wire hole is provided within the hollow sealing cover.

These and other objectives, features, and advantages of the present invention will become apparent from the following detailed description, the accompanying drawings, and the appended claims.

DETAILED DESCRIPTION OF THE PREFERRED EMBODIMENT

In order to show and describe for the purpose and skills of the present invention, below will combine preferred embodiments to further illustrate the functional and structural principles of the present invention. The general principles defined in the following description would be applied to other embodiments, alternatives, modifications, equivalents, and applications without departing from the spirit and scope of the present invention.

Figure 1:
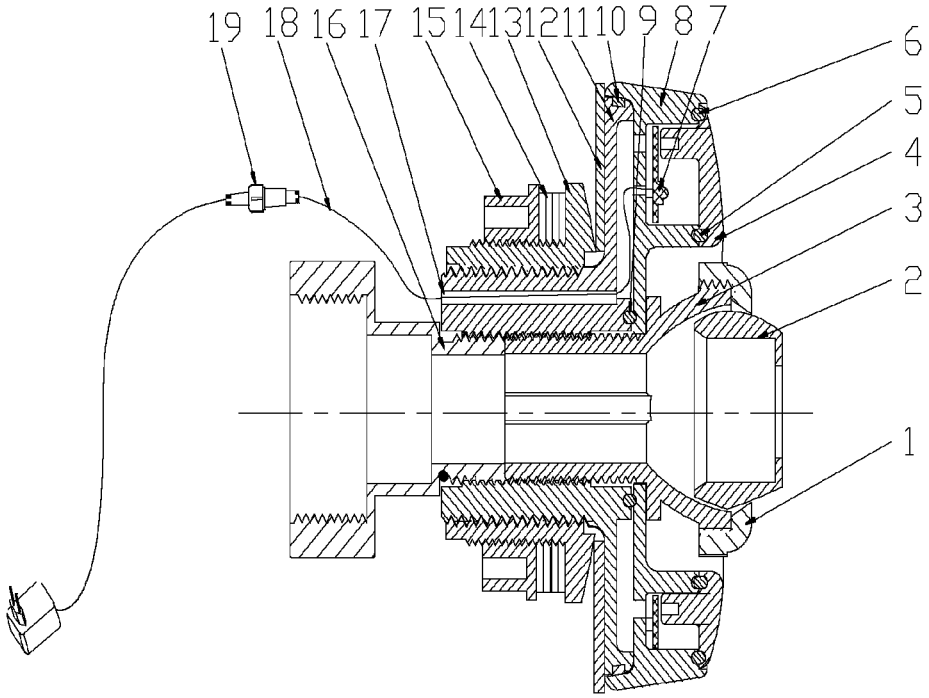
FIG. 1 is the sectional view of an underwater light for the swimming pool according to the preferred embodiment of the present invention.
Figure 2:
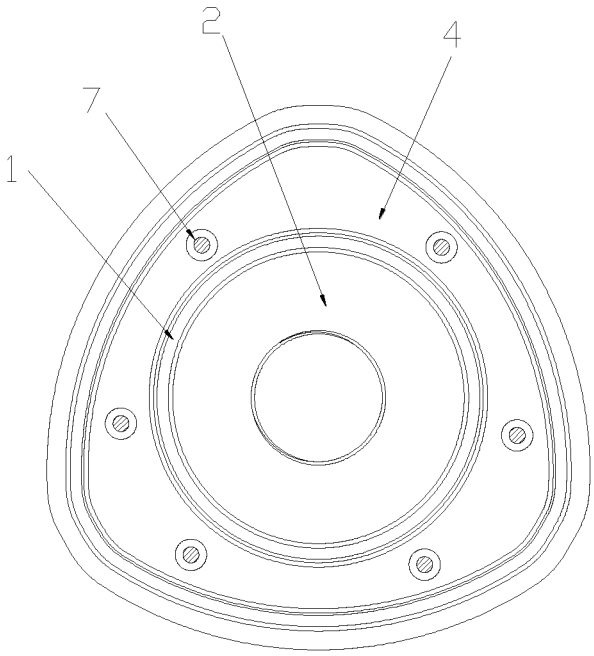
FIG. 2 is the right view of an underwater light for the swimming pool according to the preferred embodiment of the present invention.

Referring to FIG. 1 to FIG. 2 of the drawings, an underwater light according to a first preferred embodiment of the present invention is illustrated, wherein the underwater light comprises a hollow aluminum outer casing 8 and a hollow sealing cover 11. The sealing cover 11 is coupled with a head connector of a water inlet pipe 15 via a screw bolt 13. A light base 12 is provided between the sealing cover 11 and the screw bolt 13. The aluminum outer casing 8 is coupled on top of the sealing cover 11. An annular transparent light cover 4 is installed inside the aluminum outer casing 8, wherein a circuit board with diode embedded 7 is mounted within the transparent light cover 4. The internal top portion of the hollow sealing cover 11 is a thread portion, and a fastener 3, such as a screw, is coupled thereon, wherein the screw end of the fastener 3 is coupled with a nut 1 defined as an eye-ball shape so as to affix a water outlet 2. A water-proof connector head 16 is coupled with the internal bottom portion of the hollow sealing cover 11, and a wire hole 17 is provided within the hollow sealing cover 11.

It is worth mentioning that there is a water channel provided along the water-proof connector head 16, the fastener 3, and the middle of the water outlet 2, wherein the transparent light cover 4 surrounds the periphery of the water channel, so that the light is being surrounded by the water channel.

According to a second preferred embodiment of the present invention, an underwater light comprises a hollow aluminum outer casing 8 and a hollow sealing cover 11 The sealing cover 11 is coupled with a head connector of a water inlet pipe 15 via a screw bolt 13. A light base 12 is provided between the sealing cover 11 and the screw bolt 13. The aluminum outer casing 8 is coupled on top of the sealing cover 11. An annular transparent light cover 4 is installed inside the aluminum outer casing 8, wherein a circuit board with diode embedded 7 is mounted within the transparent light cover 4. The internal top portion of the hollow sealing cover 11 is a thread portion, and a fastener 3, such as a screw, is coupled thereon, wherein the screw end of the fastener 3 is coupled with a nut 1 defined as an eye balls shape so as to affix a water outlet 2. A water-proof connector head 16 is coupled with the internal bottom portion of the hollow sealing cover 11, and a wire hole 17 is provided within the hollow sealing cover 11. The underwater light further comprises a sealing gasket 14 mounted between the head connector of a water inlet pipe 15 and the fastener 3.

According to a third preferred embodiment of the present invention, an underwater light comprises a hollow aluminum outer casing 8 and a hollow sealing cover 11. The sealing cover 11 is coupled with a head connector of a water inlet pipe 15 via a screw bolt 13. A light base 12 is provided between the sealing cover 11 and the screw bolt 13. The aluminum outer casing 8 is coupled on top of the sealing cover 11. An annular transparent light cover 4 is installed inside the aluminum outer casing 8, wherein a circuit board with diode embedded 7 is mounted within the transparent light cover 4. The internal top portion of the hollow sealing cover 11 is a thread portion, and a fastener 3, such as a screw, is coupled thereon, wherein the screw end of the fastener 3 is coupled with a nut 1 defined as an eye balls shape so as to affix a water outlet 2. A water-proof connector head 16 is coupled with the internal bottom portion of the hollow sealing cover 11, and a wire hole 17 is provided within the hollow sealing cover 11. The underwater light further comprises two casing sealing rings 5, 6 located at the connection part connected between the transparent light cover 4 and the aluminum outer casing 8.

According to a fourth preferred embodiment of the present invention, an underwater light comprises a hollow aluminum outer casing 8 and a hollow sealing cover 11. The sealing cover 11 is coupled with a head connector of a water inlet pipe 15 via a screw bolt 13. A light base 12 is provided between the sealing cover 11 and the screw bolt 13, wherein the aluminum outer casing 8 is coupled on the top of the sealing cover 11. An annular transparent light cover 4 is installed inside the aluminum outer casing 8, wherein a circuit board with diode embedded 7 is mounted within the transparent light cover 4. The internal top portion of the hollow sealing cover 11 is a thread portion, and a fastener 3, such as a screw, is coupled thereon, wherein the screw end of the fastener 3 is coupled with a nut 1 defined as an eye balls shape so as to affix a water outlet 2. A water-proof connector head 16 is coupled with the internal bottom portion of the hollow sealing cover 11, and a wire hole 17 is provided within the hollow sealing cover 11. The underwater light further comprises two cover sealing rings 9, 10 mounted at the connecting portion between the aluminum outer casing 8 and the sealing cover 11.

According to a fifth preferred embodiment of the present invention, an underwater light comprises a hollow aluminum outer casing 8 and a hollow sealing cover 11. The sealing cover 11 is coupled with a head connector of a water inlet pipe 15 via a screw bolt 13. A light base 12 is provided between the sealing cover 11 and the screw bolt 13. The aluminum outer casing 8 is coupled on the top of the sealing cover 11. An annular transparent light cover 4 is installed inside the aluminum outer casing 8, wherein a circuit board with diode embedded 7 is mounted within the transparent light cover 4. The internal top portion of the hollow sealing cover 11 is a thread portion, and a fastener 3, such as a screw, is coupled thereon, wherein the screw end of the fastener 3 is coupled with a nut 1 defined as an eye balls shape so as to affix a water outlet 2. A water-proof connector head 16 is coupled with the internal bottom portion of the hollow sealing cover 11, and a wire hole 17 is provided within the hollow sealing cover 11. The underwater light further comprises a wire 18 which is passing through the wire hole 17, so as to connect with a power cord via a water-proof plug 19.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An underwater light, comprising a hollow aluminum outer casing, a hollow sealing cover, and a screw bolt, wherein said sealing cover is coupled with a head connector of a water inlet pipe via said screw bolt, wherein a light base is provided between said sealing cover and said screw bolt and said aluminum outer casing is coupled on top of said sealing cover, wherein an annular transparent light cover is installed inside said aluminum outer casing, wherein a circuit board with diode embedded is mounted within said transparent light cover, wherein a fastener is coupled at an internal top portion of said hollow sealing cover, wherein a screw end of said fastener is coupled with a nut defined as an eye balls shape so as to affix a water outlet, wherein a waterproof connector head is coupled with an internal bottom portion of said hollow sealing cover, wherein a wire hole is provided within said hollow sealing cover.

2. The underwater light, as recited in claim 1, wherein said underwater light further comprises a sealing gasket coupled between said head connector of a water inlet pipe and said screw bolt.

3. The underwater light, as recited in claim 1, wherein said underwater light further comprises two casing sealing rings coupled between said transparent light cover and aluminum outer casing.

4. The underwater light, as recited in claim 1, wherein said underwater light further comprises two cover sealing rings coupled between said transparent light cover and sealing cover.

5. The underwater light, as recited in claim 1, wherein said under water light further comprises a waterproof plug adopted for connecting a wire and a power cord and said wire being passing through a wire hole.

* * * * *